US010492996B1

(12) United States Patent
Winter

(10) Patent No.: US 10,492,996 B1
(45) Date of Patent: Dec. 3, 2019

(54) MEDICATION REMINDER

(71) Applicant: Lynn A. Winter, Bloomington, MN (US)

(72) Inventor: Lynn A. Winter, Bloomington, MN (US)

( * ) Notice: Subject to any disclaimer, the term of this patent is extended or adjusted under 35 U.S.C. 154(b) by 0 days.

(21) Appl. No.: 15/999,913

(22) Filed: Aug. 29, 2018

(51) Int. Cl.
*A61J 7/04* (2006.01)
*G09F 3/02* (2006.01)

(52) U.S. Cl.
CPC ..... *A61J 7/04* (2013.01); *A61J 2205/30* (2013.01); *A61J 2205/50* (2013.01); *G09F 2003/0272* (2013.01)

(58) Field of Classification Search
USPC ..... 40/109
See application file for complete search history.

(56) References Cited

U.S. PATENT DOCUMENTS 332,208 A 12/1885 Snider
1,317,660 A 9/1919 Carlson
1,379,079 A 11/1921 Cohen
3,996,879 A 12/1976 Walton
4,727,667 A 3/1988 Ingle
4,752,087 A 6/1988 Weisbach
4,802,438 A 2/1989 DeJonge
4,830,407 A 5/1989 Sadler, Jr. et al.
5,271,353 A 12/1993 Besthorne
5,639,529 A 6/1997 Gozdecki et al.
5,720,392 A 2/1998 Price
5,809,674 A 9/1998 Key
5,823,346 A 10/1998 Weiner
5,881,597 A 3/1999 Brooks
5,979,698 A 11/1999 Deal
6,068,149 A * 5/2000 Telega ..... A61J 7/04 116/308
6,086,697 A 7/2000 Key
6,550,171 B1 4/2003 DeWerra et al.
(Continued)

*Primary Examiner* — Kristina N Junge

(57) ABSTRACT

A very simple, effective medication reminder used to designate the day of the week and the daily dosage number of the most recent medication dosage taken by the user (or alternatively the day of the week and the next dosage number to be taken). This invention can be used with medication containers of various sizes and shapes. It can be used over and over on the same pill bottle or it and be easily removed and placed on a new pill bottle. The device is placed on the exterior perimeter of the medication container and comprises a calendar and a marker assembly. The calendar shows the days of the week and is attached to the vertical side of the pill bottle using a weak adhesive. The marker assembly comprises an elastic band and a small tubular shaped sliding marker with the elastic band passing through an axial hole through the sliding marker. The elastic band of the marker assembly is placed over the calendar and around the pill bottle such that it can be repositioned vertically along the perimeter of the pill bottle. The elastic band holds the marker assembly in place by having a small amount of tension in the band. The sliding marker can be rotated about the band to show the daily dosage number and can slide laterally along the elastic band. The user can thus reposition the elastic band and the sliding marker to designate the calendar date and the daily dosage number of the most recent medication dosage taken.

7 Claims, 2 Drawing Sheets

(56) References Cited

U.S. PATENT DOCUMENTS

| | | | | |
|---|---|---|---|---|
| 6,649,007 | B1 | 11/2003 | Key | |
| 6,770,345 | B2 | 8/2004 | Sellers | |
| 6,802,279 | B1 | 10/2004 | Johnson | |
| 7,387,208 | B2 | 6/2008 | Londino | |
| 7,740,411 | B2 | 6/2010 | Kaufman | |
| 7,874,429 | B2 | 1/2011 | Londino | |
| 7,874,594 | B2 | 1/2011 | Flynn et al. | |
| 7,921,583 | B2 | 4/2011 | Londino | |
| 7,926,851 | B2 | 4/2011 | Kaufman | |
| 8,181,371 | B2 | 5/2012 | Londino | |
| 8,281,733 | B2 | 10/2012 | Kreshek | |
| 8,973,755 | B2 | 3/2015 | Key | |
| 9,021,981 | B2 | 5/2015 | Raiti de Boyles | |
| D730,990 | S | 6/2015 | Stanton | |
| D739,466 | S | 9/2015 | Stanton | |
| 9,142,148 | B2 | 9/2015 | Stanton | |
| 9,795,198 | B1 * | 10/2017 | Krieger | G09F 3/02 |
| 9,855,193 | B2 * | 1/2018 | O'Doherty | A61J 7/04 |
| 2005/0056203 | A1 * | 3/2005 | Giewercer | A61J 7/04 116/308 |
| 2006/0108257 | A1 * | 5/2006 | Packard | A61J 7/04 206/534 |
| 2013/0278948 | A1 * | 10/2013 | Miller | G06K 15/024 358/1.6 |

* cited by examiner

FIG. 4
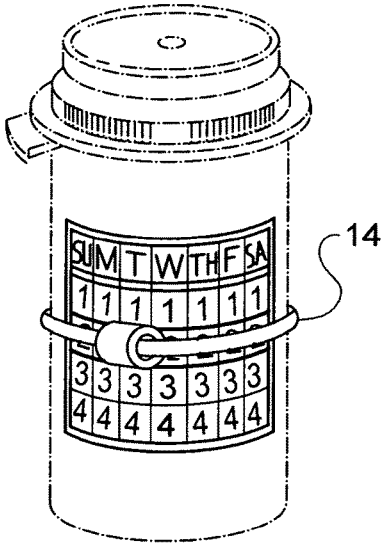
FIG. 5
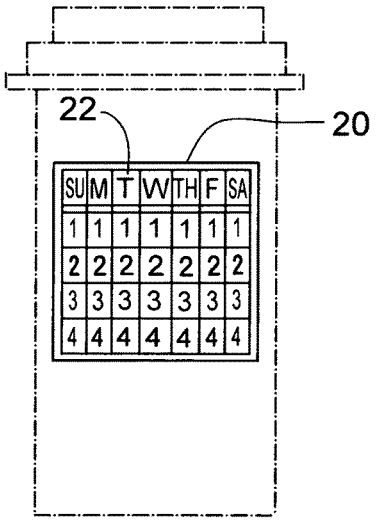
FIG. 6
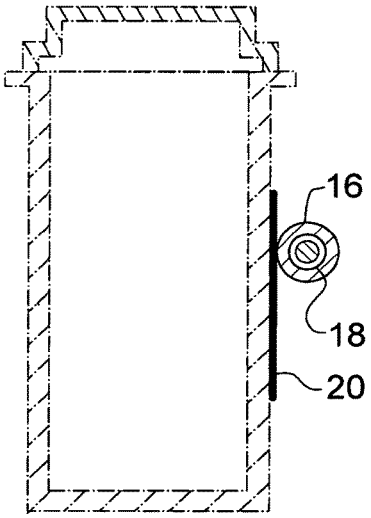
FIG. 7
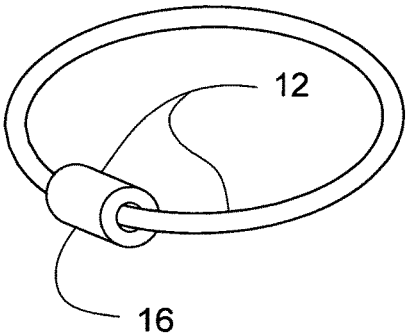
FIG. 8
| | | |
|---|---|---|
| 1 | SU | 2 |
| 1 | M | 2 |
| 1 | T | 2 |
| 1 | W | 2 |
| 1 | TH | 2 |
| 1 | F | 2 |
| 1 | SA | 2 |
24
FIG. 9
| | | | | |
|---|---|---|---|---|
| 1 | 3 | SU | 2 | 4 |
| 1 | 3 | M | 2 | 4 |
| 1 | 3 | T | 2 | 4 |
| 1 | 3 | W | 2 | 4 |
| 1 | 3 | TH | 2 | 4 |
| 1 | 3 | F | 2 | 4 |
| 1 | 3 | SA | 2 | 4 |
FIG. 10
| | | |
|---|---|---|
| 1/2 | SU | 3/4 |
| 1/2 | M | 3/4 |
| 1/2 | T | 3/4 |
| 1/2 | W | 3/4 |
| 1/2 | TH | 3/4 |
| 1/2 | F | 3/4 |
| 1/2 | SA | 3/4 |
FIG. 11
20
| SU | M | T | W | TH | F | SA |
|---|---|---|---|---|---|---|
| 1 | 1 | 1 | 1 | 1 | 1 | 1 |
| 2 | 2 | 2 | 2 | 2 | 2 | 2 |
| 3 | 3 | 3 | 3 | 3 | 3 | 3 |
| 4 | 4 | 4 | 4 | 4 | 4 | 4 |

MEDICATION REMINDER

CROSS-REFERENCE TO RELATED APPLICATIONS

Not Applicable

FEDERALLY SPONSORED RESEARCH

Not Applicable

SEQUENCE LISTING OR PROGRAM

Not Applicable

FIELD OF THE INVENTION

This invention relates generally to a medication reminder device, and more specifically to a medication reminder device using a self-adhesive calendar attached to the exterior surface of a medication container, and an elastic band with a sliding marker positioned over the calendar and encircling the perimeter of the container to designate the day and dosage number of the last medication dosage taken.

BACKGROUND OF THE INVENTION

Millions of people are currently required or advised to take over-the-counter or prescription medications on a daily basis or at specific intervals during the day. One of the major problems associated with periodic medications is the difficulty in remembering to take a medication, or remembering whether or not a particular scheduled medication has been taken. For example, it is not unusual for an individual to be prescribed medication to be taken three or four times a day. At times during the day, the user may not have a clear memory of whether or not a medication had been taken. Without an effective method of recording medication information, individuals and medical personnel may have difficulty remembering if and when pills were taken. The user or medical personnel need to know when the last dosage was taken in order to prevent overdosing. If an individual loses track they may end up missing a dosage or taking double their prescribed dosages, both of which can be dangerous to the individual's health. Incorrect consumption can result in ineffectiveness of the medicine or extending the length of an illness. Additionally, it is common that some individuals are required to take important medications for mental health on a prescribed schedule wherein forgetting to take a medication may have severe consequences. The same holds true for heart medications and a whole list of important pharmaceutical treatments.

Over the years, numerous efforts have been undertaken to include physical reminders on medication containers to remind the individual taking the pill to take the correct pill at the proper interval. For example, a reminder device for medication containers has been proposed which includes complex rotatable dials disposed within the cap of a pill bottle. One dial may include the day and another dial may display the time of day or the medication interval number for the day.

An example of a rather complex medication reminder is provided in U.S. Pat. No. 5,720,392, issued to Price which discloses a prescription timer that includes a clock face placed upon the bottle cap that also includes an additional portable transparent overlaying cap that can be rotated to show a predetermined time for taking a pill. A clock face of a size to be applied to the top of a medication container cap would be inordinately small for use by many individuals, especially those with limited vision. The relatively small size would also render it inconvenient to use and subject to inaccurate readings.

Another example of a medication reminder is U.S. Pat. No. 9,021,981, issued to Raiti de Boyles that discloses a Pill Reminder Wheel that is to be mounted on a surface of a medication container. This invention comprises two disks and a dial. The base disk shows the day, and the cover disk designates the dosage number. The dial points to the dosage number indicia. The assembly is flat and would only be suitable for containers having a reasonably large flat surface on which to mount the device. It would be extremely small and difficult to read and operate if, for example, it were to be used on a small tubular shaped bottle. This type of device would require manufacturing of various sized units to accommodate medication containers of various shapes and sizes.

While numerous types of solutions to the problem of remembering to timely administer medications have been suggested, none of these solutions have gained wide-spread acceptance. Some of the more expensive proposed solutions can be used effectively but are too complex, cumbersome, and costly to be applied to the wide variation in the configuration of medication containers being manufactured and utilized. Presently known medication reminder systems have not achieved a high degree of acceptance and use. Consequently, there is an obvious need for a simple, practical, effective, and inexpensive reminder system for reminding users to consistently take their medications in a timely manner. An innovative solution with significant advantages is needed in order to overcome the shortcomings of the prior art.

BRIEF SUMMARY OF THE INVENTION

In view of the foregoing discussion of the importance of an effective medication reminder system, and especially a convenient medication reminder that will be consistently and diligently used by those requiring daily or periodic medications during the day is universally understood. The reminder should be conveniently located near the medication and clearly depict the day of the week and time or daily dosage number of the most recent medication dosage taken (or the next dosage to be taken). The medication reminder should be easily understandable, and easy to use by individuals having limited vision and limited manual dexterity. Considering the disadvantages of the prior art, there is a need for a more versatile, practical medication reminder that introduces new and significant advantages and overcomes the drawbacks of presently available reminders by attaining the following objectives:

(a) A medication reminder that is very simple, practical, effective, and easy to understand and use without requiring a high level of manual dexterity by the user.

(b) A medication reminder that can be easily and inexpensively manufactured.

(c) A medication reminder that is versatile and can be used with medication containers of any cross-sectional configuration, and that can be used either on flat or curved surfaces.

(d) A medication reminder that can be easily installed and removed from the medication container.

(e) A medication reminder that can be used over and over, week after week without ever requiring pencil marks or any other markings on the associated calendar component.

(f) A medication reminder that does not require periodic replacement or replacement of any of the components.

(g) A medication reminder that can be removed from one medication container and placed on another medication container and used there.

(h) A medication reminder that is used conveniently at the location of the medication container (on the medication container itself) right where the medication is located.

(i) A medication reminder that is not cumbersome but is readily noticeable and readable by those having limited vision.

This invention is a very simple, effective medication reminder that can be placed on a typical medication container (pill bottle) to designate the day of the week and the daily dosage number of the most recent medication dosage taken by the user. The medication container is not included as part of this invention. The invention comprises a marker assembly and a calendar. The marker assembly further comprises an elastic band and a sliding marker. The sliding marker is tubular shaped with an axial hole through which the elastic band passes. The sliding marker may have flat sides and indicia showing the dosage numbers on the flat sides. The calendar has indicia depicting the days of the week, and in an alternate embodiment, also comprises indicia of the daily dosage numbers. For use, the calendar is attached to the exterior side of the medication container using a weak adhesive. The marker assembly is placed over the calendar with the elastic band encircling the perimeter of the medication container. A small amount of tension in the elastic band holds the marker in place on the medication container.

The elastic band can be easily repositioned vertically over the calendar, and the sliding marker can be repositioned laterally over the calendar. The sliding marker can be of square or other flat sided cross-sectional configuration with dosage numbers shown on one or more sides. The sliding marker can be rotated about the elastic band to show the selected dosage number. Or, in an alternate embodiment, the sliding marker can be circular or elliptical in cross-sectional configuration, and wherein the dosage numbers are included on the calendar rather than on the sliding marker. The calendar is a made of a thin stick-on sheet of coated paper or plastic attached to the medication container using a weak adhesive. In use, the elastic band and the sliding marker can be positioned to show the day of the week and the dosage number of the most recent dosage taken (or, alternatively, the next dosage to be taken) by the user.

BRIEF DESCRIPTION OF THE DRAWINGS

FIG. 4 is a top perspective view of another embodiment of the medication reminder invention comprising a one week calendar depicting dosage numbers 1 through 4 and a sliding marker of circular cross-sectional configuration.

FIG. 5 is a front view of a typical weekly calendar depicting dosage numbers 1 through 4 according to FIG. 4.

FIG. 6 is a side sectional view of the medication reminder invention according to FIG. 4.

FIG. 7 is a top perspective view of the marker assembly according to FIG. 4.

FIG. 8 is an example of a weekly calendar depicting dosage numbers 1 and 2 according to FIG. 4.

FIG. 9 is an example of a weekly calendar depicting dosage numbers 1 through 4 according to FIG. 4.

FIGS. 10 and 11 are additional examples of weekly calendars depicting dosage numbers 1 through 4 according to FIG. 4.

DRAWING REFERENCE NUMERALS OF THE ELEMENTS

| Elements | | | |
|---|---|---|---|
| 10 | medication reminder | 18 | hole |
| 12 | marker assembly | 20 | calendar |
| 14 | elastic band | 22 | day |
| 16 | sliding marker | 24 | dosage number |

DETAILED DESCRIPTION OF THE INVENTION

The examples used herein are intended merely to facilitate an understanding of the ways in which the various embodiments of the invention may be practiced and to further enable those having skill in the art to practice the principles and concepts of the invention. Accordingly, the examples given should not be construed as limiting the scope of the invention.

Figure 1:
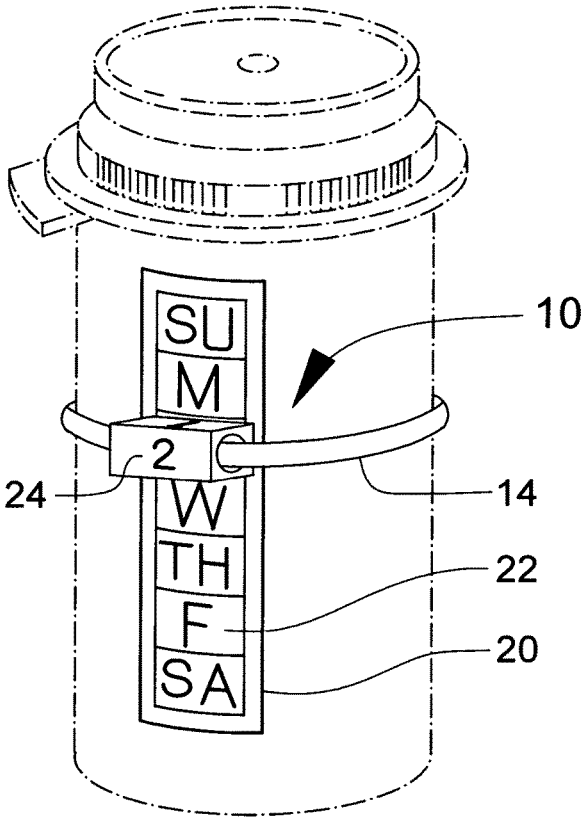
FIG. 1 is a top perspective view of the medication reminder invention comprising a one week calendar and a sliding marker of square cross-sectional configuration depicting 4 dosage numbers, 1 dosage number on each side of the sliding marker.

Reference is now made to the drawings wherein like numerals designate like parts throughout. Reference is made first to FIG. 1 showing a preferred embodiment of the medicine reminder 10 invention applied to a typical medication container. The medication container (pill bottle) is not included as part of this invention but can be of circular, square, or any other cross-sectional configuration. This invention comprises marker assembly 12 and calendar 20. Marker assembly 12 further comprises elastic band 14 and sliding marker 16 wherein sliding marker 16 further comprises hole 18 disposed axially through sliding marker 16, and may include dosage number 24 as shown on FIG. 1. Sliding marker 16 can be made from durable plastic, hard rubber, nylon, fiberglass, aluminum, or wood.

Figure 3:
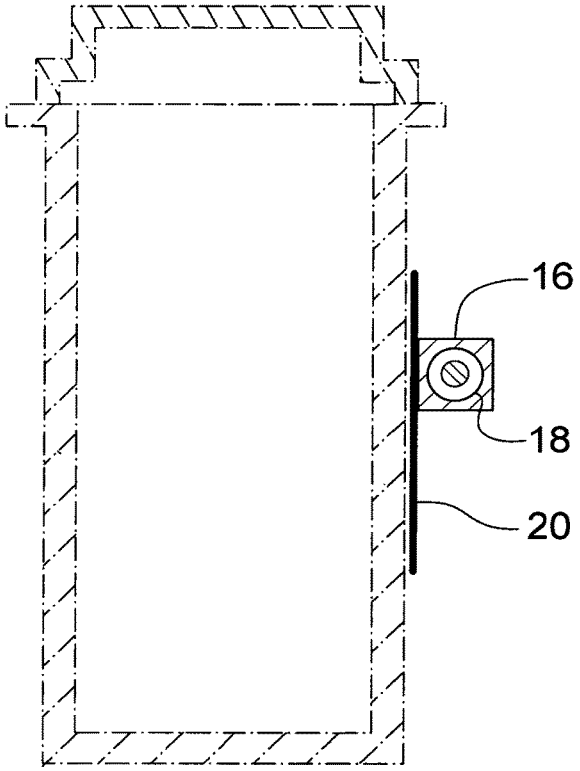
FIG. 3 is a side sectional view of the medication reminder invention according to FIG. 1.
Figure 2:
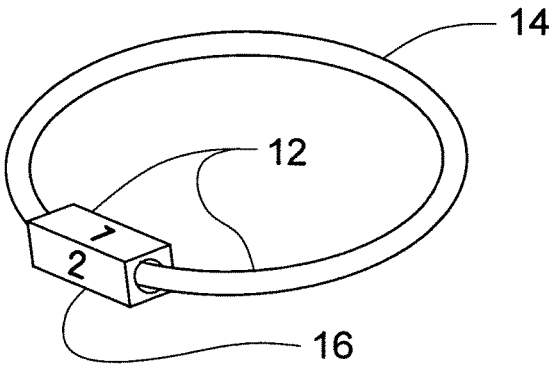
FIG. 2 is a top perspective view of the marker assembly according to FIG. 1.

Calendar 20 comprises indicia of days of the week 22. Or, in an alternate embodiment, calendar 20 also comprises indicia of the daily dosage number 24. For use, calendar 20 is applied to the vertical exterior surface of the medication container, and then marker assembly 12 is applied to the medication container with band 14 positioned over calendar 20 and encircling the exterior perimeter of the medication container, while passing axially through hole 18 of sliding marker 16. Elastic band 14 is made of resilient elastic material similar to the elastic rubber of a common rubberband. The amount of tension of elastic band 14 is sufficient to hold marker assembly 16 in place around the perimeter surface of the medication container, but loose enough such that marker assembly can be easily repositioned up or down vertically by the user. With this embodiment, elastic band 14 is preferably circular or slightly elliptical in cross-sectional configuration and is slightly smaller than hole 18 of sliding marker 16 such that sliding marker 16 can easily slide laterally along elastic band 14 when urged by the user. Hole 18 is similar in cross-sectional configuration to elastic band 14 but is slightly larger and passes laterally through the cross-sectional center of sliding marker 16.

in a preferred embodiment, sliding marker 16 can be tubular and triangular, square, hexagonal or octagonal in exterior cross-sectional configuration and having a dosage number 24 on each of the flat sides wherein sliding marker 16 is rotated about elastic band 14 by the user to show the selected dosage number 24 on the outwardly facing flat side of sliding marker 16. Or, on another embodiment, sliding marker 16 can be circular or elliptical in cross-sectional configuration wherein dosage numbers 24 are included on calendar 20 (FIGS. 4-11), rather than on marker 16. Calendar 20 comprises indicia depicting the days of the week 22 (FIGS. 1-3) and, in an alternate embodiment (FIGS. 4-11), calendar 20 also includes indicia depicting the daily dosage numbers 24. Calendar 20 can be made of thin stick-on sheet material such as coated paper or plastic that is either permanently or removably attached to the exterior perimeter surface of the medication container using a weak adhesive. Days of the week 22 and daily dosage numbers 24 are letters and numerals, respectively, used to designate the day of the week and the daily dosage number 24. In use, the user positions sliding marker 16 laterally, and positions elastic band 14 vertically over the selected point of calendar 20 to show the day of the week 22 and the daily dosage number 24 of the most recent medication dosage taken.

With this simple invention, the user can easily reposition the marker assembly 12 up or down, and reposition the sliding marker 16 laterally to position sliding marker 16 to a location on calendar 20 to show the day of the week 22 and the dosage number 24 of the most recent medication taken by the user (or, alternatively, the next upcoming day 22 and dosage number 24 of the medication to be taken). Sliding marker 16 is of sufficient length to cover one day 22 or one dosage number 24 of an associated day 22 of calendar 20, and has a cross-sectional configuration to contain hole 18. No pencil marks or other markings are ever needed to be marked on the calendar 20, and calendar 20 and the marker assembly 12 can remain in use on the same medication container and be used over and over, week after week. Or, if a new medication container is to be used, the user can remove the calendar 20 and the marker assembly 12 and place them on the new medication container to be used there.

The major advantages of this invention are:

(a) The medication reminder is very simple, practical, effective, and easy to understand and use without requiring a high level of manual dexterity by the user.

(b) The medication reminder can be easily and inexpensively manufactured.

(c) It is versatile and can be used with medication containers of any cross-sectional configuration, and it can be used on either flat or curved surfaces.

(d) It can be easily installed and removed from the medication container.

(e) It can be used over and over, week after week without ever requiring pencil marks or any other markings on the associated calendar component.

(f) It does not require periodic replacement or replacement of any of the components.

(g) It can be removed from one medication container and placed on another medication container and used there.

(h) It can be used conveniently at the location of the medication container (on the medication container itself) right where the medication is located.

(i) It is not cumbersome but is readily noticeable and readable by those having limited vision.

OPERATION AND USE OF THE INVENTION

This medication reminder tracks when the last day and dosage of a medicine or vitamin was taken or, alternatively, when the next dosage is due to be taken. The user attaches the calendar to the exterior vertical side of the medication container. Then the user places the elastic band of the marker assembly over the calendar and around the exterior perimeter of the medication container. The elastic band can be positioned or repositioned vertically, and the sliding marker of the marker assembly can be moved laterally along the elastic band over the calendar to place the sliding marker anywhere over the calendar in a selected position to designate the day of the week and the daily dosage number of the most recent medication dosage taken by the user (or alternatively, to designate the day and dosage number of the next scheduled dosage to be taken). The elastic band and the sliding marker can be repositioned as needed to designate a change in the day of the week and/or a change in the medication dosage number. The medication reminder can remain on the same medication container to be used over and over, week after week. Or, if a different medical container is to be used, the medication reminder can be easily removed from the original medication container and installed on the new container. No pencil marks or other markings are ever needed.

CONCLUSION

It should be understood that the phraseology or terminology employed herein is for purposes of description and not of limitation. The above description is considered that of the preferred embodiments only. While these embodiments of the invention have been shown on the drawings and described herein, it is to be understood that they are merely for illustrative purposes only and not intended to limit the scope of the invention. Workers skilled in the art will recognize additions, deletions, and other modifications that can be made in form and detail without departing from the spirit and scope of the invention. Thus, the scope of the invention should be determined by the appended claims, and not by the specific examples given.

Currently available medication reminder devices are typically rather complex and too small to be practical and used conveniently when attached to the wide assortment of sizes and shapes of medication containers presently in use. They are often cumbersome to use by individuals with limited manual dexterity, and they can be difficult to read and understand by users having limited vision. Thus, many individuals forgo their use and depend on their sometimes-unreliable memory to comply with their medication schedule. This can result in missed medication dosages or double doses. Inaccurate timing of medications taken can result in adverse health effects and longer illnesses.

From the above-described features, it can be seen that this invention is unique and has a number of significant advantages over the prior art. It is a simple, versatile, and convenient medication reminder that is appropriate for use with any medication container regardless of the shape and size of the container. It is easy and inexpensive to manufacture and can be used over and over, week after week on the same container, or it can be removed and used on a different container. Clearly, this invention is well adapted to meet the conditions of practical use, and it should be evident that this invention provides many advantages, is novel, and worthy of patentable merit over the prior art.

The invention claimed is:

1. A simple medication reminder device that can be installed on an exterior surface of a medication container to designate a day of the week and a dosage number of a most recent said dosage number taken or a next scheduled said dosage number to be taken by a user, said medication reminder comprises a calendar depicting indicia of said dosage numbers and indicia of said days of the week, further wherein said indicia of dosage numbers and said indicia of days of the week are aligned generally perpendicular to one another, said calendar to be attached to said exterior perimeter surface of said medication container, and also comprises a marker assembly, said marker assembly further comprises a resilient elastic band and a tubular sliding marker wherein said elastic band traverses laterally through an axial hole through said sliding marker such that said sliding marker can be easily urged to slide laterally along said elastic band, further wherein said elastic band along with said sliding marker is placed around said exterior perimeter surface of said medication container over said calendar such that said elastic band, having a predetermined amount of tension, is capable of remaining in place or being easily repositioned vertically and wherein said sliding marker is thus capable of being easily moved laterally along said elastic band and moved vertically in order to be located or relocated over any position of said calendar such that said user can position or reposition said marker over said calendar to designate both said dosage number and said day of the week simultaneously.

2. The medication reminder of claim 1 wherein said sliding marker has an exterior cross-sectional configuration that is a flat sided figure having one said dosage number depicted on at least one of said flat sides.

3. The medication reminder of claim 1 wherein said sliding marker has an exterior cross-sectional configuration that is circular or elliptical, and wherein said calendar further comprises said indicia of at least one said dosage number associated with each said day.

4. The medication reminder of claim 2 wherein said indicia of said days of said calendar are aligned vertically.

5. The medication reminder of claim 2 wherein said indicia of said days of said calendar are aligned horizontally.

6. The medication reminder of claim 3 wherein said indicia of said days of said calendar are aligned vertically and said indicia of said dosage numbers of said calendar are aligned horizontally.

7. The medication reminder of claim 3 wherein said indicia of said days of said calendar are aligned horizontally and said indicia of said dosage numbers of said calendar are aligned vertically.

* * * * *